United States Patent [19]

Van Benthuysen

[11] 3,932,832

[45] Jan. 13, 1976

[54] PLUG-IN SHAFT FOR ELECTRICAL CONTROL

[75] Inventor: John D. Van Benthuysen, Elkhart, Ind.

[73] Assignee: CTS Corporation, Elkhart, Ind.

[22] Filed: Mar. 18, 1974

[21] Appl. No.: 452,126

[52] U.S. Cl. ..... 338/166; 338/175

[51] Int. Cl.[2] ..... H01C 10/34

[58] Field of Search ..... 338/166, 174, 162, 163, 338/175; 200/42 R, 43, 44

[56] References Cited

UNITED STATES PATENTS

| | | | |
|---|---|---|---|
| 2,257,979 | 10/1941 | Rubinstein | 338/166 X |
| 2,669,634 | 2/1954 | Daily et al. | 338/166 |
| 2,717,944 | 9/1955 | Daily et al. | 338/174 X |
| 3,032,734 | 5/1962 | Zunker et al. | 338/163 |
| 3,375,478 | 3/1968 | Van Benthuysen | 338/174 |
| 3,382,473 | 5/1968 | Van Benthuysen et al. | 338/166 |
| 3,662,314 | 5/1972 | Heredero | 338/174 |
| 3,837,661 | 9/1974 | Phillippi | 403/290 |

FOREIGN PATENTS OR APPLICATIONS

| | | | |
|---|---|---|---|
| 37,445 | 1/1956 | Germany | 338/166 |

*Primary Examiner*—Bruce A. Reynolds

[57] ABSTRACT

A plug-in shaft is provided for insertion into a noncircular opening provided in a driver and integral hub of a variable resistance control providing a means to alter the rotational torque of the control. Integral with the hub is a dish shaped abuttment section and a driver engagement portion of the shaft supports a plurality of nubbins engaging the abuttment section of the hub upon insertion of the shaft into the noncircular opening to secure the shaft in a predetermined position within the slot. The nubbins engaging the dish shaped abuttment section provide radial pressure on the hub and restrain the axial movement of the shaft within the noncircular opening. An alignment portion of the shaft contiguous with the driver engagement portion rigidly prealigns the shaft in an upright and intact manner within the noncircular opening before the engagement portion and nubbins engage the noncircular opening.

6 Claims, 5 Drawing Figures

PLUG-IN SHAFT FOR ELECTRICAL CONTROL

The present invention relates to electrical controls, and more particularly, to an electrical control such as a variable resistor operable with a plug-in shaft.

When altering the rotational torque of a variable resistance control, such as the control described in U.S. Pat. No. 3,375,478 assigned to the same assignee as the present invention, it is generally necessary to alter the heat swaging process or the process of securing the driver to the collector ring of the control. Normally, to secure the driver to the collector ring and provide the necessary turning torque for this type of control, the end of a hub integral with the driver is inserted into an aperture provided in the collector ring and heat swaged against the surface of the collector ring. To increase the rotational torque, for example, for the above mentioned control, a button or raised portion is provided in the center of the surface supporting the driver of the control in the heat swaging process to urge the hub further into the aperture provided in the collector ring. However, changes in the heat swaging process in the assembly of a control merely to alter the rotational torque are uneconomical. It would therefore be desirable to provide a shaft for a variable resistance control having means for altering the rotational torque of the variable resistance control without altering the heat swaging process.

Plug-in shafts have often been employed with electrical controls such as the shaft disclosed in U.S. Pat. Nos. 2,669,634 and 3,382,473 assigned to the same assignee as the present invention. Prior art plug-in shafts generally have nubbins integral with the shaft for securing the shaft to the control and have extensions beyond the nubbins providing the means to actuate the control from alternate sides. However, the nubbins do not provide the means to alter the rotational torque of the control nor do the extensions beyond the nubbins provide the means to rigidly hold the shaft in an upright and intact manner within a slot in the control before the nubbins engage the slot to secure the shaft to the control. It would therefore be desirable to provide a plug-in shaft for a variable resistance control with integral nubbins and a shaft extension beyond the nubbins providing the means to alter the rotational torque of the control and to rigidly prealign the shaft within the control.

Accordingly, it is an object of the present invention to provide a new and improved variable resistance control with a plug-in shaft.

Another object of the present invention is to provide a new and improved plug-in shaft for a variable resistance control that provides a means to alter the rotational torque of the variable resistance control.

Another object of the present invention is to provide a new and improved plug-in shaft for a variable resistance control having an engagement portion and an elongated alignment portion extending beyond the engagement portion for rigidly prealigning the shaft upright and intact within one end of a slot in a driver in the control before insertion of the engagement portion into the slot.

Still another object of the present invention is to provide a plug-in shaft for a variable resistance control having a driver and integral hub with an abuttment section and a dish shaped surface defining a portion of the abuttment section and wherein each side of the shaft is provided with an integral resilient nubbin engaging the dish shaped surface to attach the shaft to the driver and exert outward radial pressure on the abuttment section.

Further objects and advantages of the present invention will become apparent as the following description proceeds and the features of novelty characterized in the invention will be pointed out with particularity in the claims annexed to and forming a part of this specification.

Briefly, the present invention is concerned with a variable resistance control having a rotatable driver operable with a plug-in shaft. The driver is provided with a hub having an abuttment section disposed therein and a dish shaped surface defining a portion of the abuttment section and a noncircular opening extends through the driver and integral hub for receiving the plug-in shaft. The plug-in shaft comprises an engagement portion having a plurality of sides with a resilient nubbin integral with each of the sides for engaging the dish shaped surface of the abuttment section upon the insertion of the shaft into the driver. The engagement of the resilient nubbins with the dish shaped surface secures the shaft to the driver restricting axial movement and exerts outward radial pressure on the abuttment section of the hub. An alignment portion contiguous with the engagement portion provides an extension of the shaft beyond the resilient nubbins and the sides of the alignment portion interfit with the sides of the noncircular opening to hold the shaft upright and intact within the opening before the engagement portion of the shaft and the resilient nubbins engage the noncircular opening.

For a better understanding of the present invention, reference may be had to the accompanying drawings wherein the same reference numerals have been applied to like parts and wherein.

Figure 1:
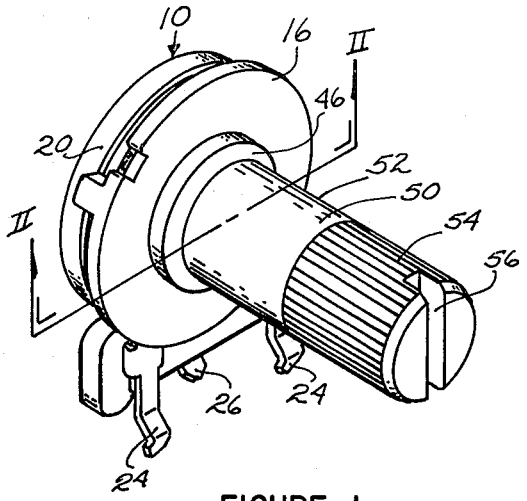
FIG. 1 is an isometric view of an improved electrical control built in accord with the present invention.

Referring now to the drawings, there is illustrated a variable resistance control, generally indicated at 10, comprising a mounting bracket 12 with an integral collector ring 14 embossed from the plane of the mounting bracket 12, a rotatable member or driver 16 of suitable electrically nonconductive heat deformable material such as nylon journaled in an aperture 18 provided in the collector ring 14, and a suitable electrically nonconductive base 20 supporting a suitable resistance element 22, e.g., a carbon composition resistance element, in spaced relationship with the collector ring 14. The ends of the resistance element 22 are connected to a pair of terminals 24 suitably secured to the base 20 and the mounting bracket 12 is provided with a depending snapin finger 26 for mounting and electrically connecting a portion of the variable resistance control 10 to a panel or the like. A contactor 28 constrained to rotate with the driver 16 wipingly engages and electrically connects the collector ring 14 and the resistance element 22. It is to be understood that the mounting bracket 12 could be provided with rearwardly extending snap-in fingers for an alternate mounting of the variable resistance control to a panel.

Integral with the driver 16 and extending rearwardly therefrom are a skirt 32 rotatably bearing upon a portion of the base 20 and a spindle or hub 34 journaled in the aperture 18 of the collector ring 14. The edge of the hub 34 projecting outwardly from the collector ring is heat swaged to the collector ring forming a rolled over portion 36 of the hub against the rear surface 38 of the collector ring to assure a tight bearing fit between the hub 34 and the aperture 18 of the collector ring 14 and to eliminate longitudinal movement of the hub 34.

Figure 3:
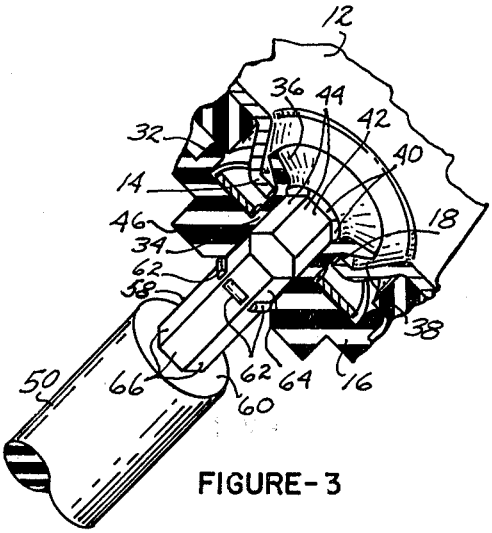
FIG. 3 is a fragmentary isometric view of the driver and the plug-in shaft shown in FIG. 2 with a section of the driver removed to show the inner configuration of the slot provided therein.
Figure 5:
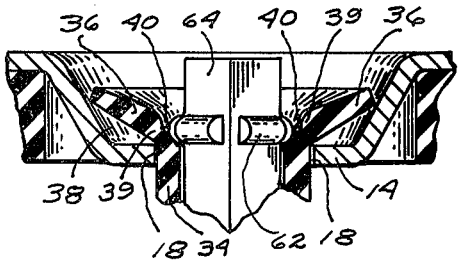
FIG. 5 is an enlarged view of the engagement of the driver and the plug-in shaft.

In accord with the present invention the hub 34 comprises an abuttment member 39 provided with a dish-shaped or chamfered surface 40, the abuttment member being integral with the rolled over portion 36 as best seen in FIG. 5 and defining a portion of the noncircular opening 42 extending through the driver 16 and hub 34. The noncircular opening 42 extending through the center of the driver 16 and hub 34 is defined by the walls 44 extending through the driver and the hub and by the rolled over portion 36 of the hub 34, in addition to the chamfered surface 40 of the hub 34, as best seen in FIG. 3. To actuate the driver 16, a plug-in shaft 50 preferably of a molded material such as nylon is provided for insertion into the noncircular opening 42 in the driver 16 and hub 34 and the shaft 50 is provided with an actuator portion 52 containing a knurled section 54 and a groove 56 to facilitate the rotation thereof.

Figure 2:
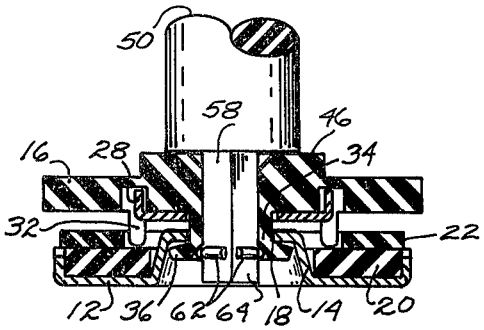
FIG. 2 is a sectional view of the control shown in FIG. 1.
Figure 4:
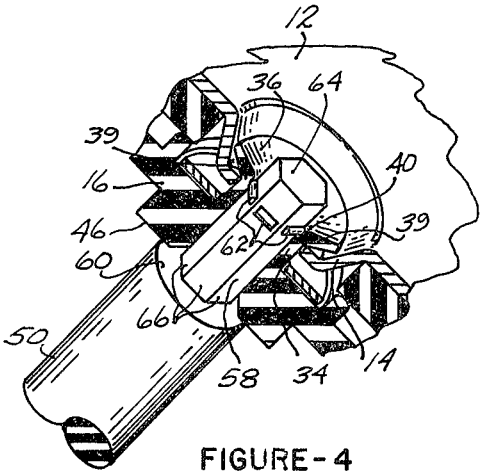
FIG. 4 is a fragmentary isometric view of the driver with engaged plug-in shaft.

In accord with the present invention, the shaft 50 is also provided with a hexagonally shaped driver engagement portion 58 integral with the actuator portion 52 defining a shoulder 60 and supporting a plurality of resilient nubbins 62 and is provided with an alignment portion 64 contiguous with the driver engagement portion 58. Upon insertion of the driver engagement portion 58 of the shaft into the slot 42 as best seen in FIGS. 2 and 4, the shoulder 60 abuts a bearing surface 46 embossed from a surface of the driver 16 and limits the inward axial movement of the shaft 50 into the noncircular opening 42. Each of the sides 66 of the hexagonally shaped driver engagement portion 58 supports a molded resilient nubbin 62 disposed between the shoulder 60 and the end of the alignment portion 64 and the sides 66 of the driver engagement portion engage the sides of the noncircular opening 42 to interfit the driver engagement portion 58 within the noncircular opening 42. Preferably, with the shaft inserted into the noncircular opening 42 and the shoulder 60 of the shaft abutting the bearing surface 46 of the driver, the driver engagement portion 58 of the shaft 50 extends into the noncircular opening 42 with the resilient nubbins 62 abutting the chamfered surface 40 of the abuttment member 39. The resilient nubbins 62 engage the chamfered surface 40 to secure the shaft 50 to the driver 16 and to restrict the outward axial movement or withdrawal of the shaft 50 from the noncircular opening 42 in the direction of the actuator portion 52 of the shaft 50. The engagement of the resilient nubbins 62 against the chamfered surface 40 of the abuttment member 39 exerts pressure on the abuttment member 39 and a degree of outward radial pressure on the hub 34 in the direction of the surface of the aperture 18 of the collector ring 14 due to outward axial movement of the shaft and to the slope of the chamfered surface 40, as best seen in FIG. 5. The outward radial pressure exerted by the hub 34 against the surface of the aperture 18 of the collector ring 14 affects the rotational torque of the driver 16 of the control. The size of the resilient nubbins 62 can also be arranged to provide a plug-in pull-out shaft or a plug-in non-pull out shaft depending upon the particular application.

Preferably, in the assembly of the shaft to the driver, the shaft 50 is first aligned and partially inserted into the noncircular opening 42 in the driver 16 by an operator and then the shaft 50 is completely inserted into the driver 16 with the shoulder 60 abutting the bearing surface 46 and the nubbins 62 engaging the chamfered surface 40 of the abuttment member 39. Preferably, the shaft 50 is press fit into the slot 42 and as the shaft 50 is inserted in the noncircular opening 42, the resilient nubbins 62 and the walls 44 of the noncircular opening 42 flexing sufficiently to permit the nubbins 62 to pass beyond the walls 44 into engagement with the chamfered surface 40. The alignment portion 64 of the shaft 50 provides an alignment means for prealigning the shaft with the noncircular opening 42. With reference to FIG. 3, the shaft is partially inserted into the noncircular opening 42 with the nubbins 62 free from engagement with the sides 44 of the noncircular opening 42, the alignment portion 64 holding the shaft upright and intact within the slot. Preferably, the sides of the alignment portion 64 conform to the sides 44 of the noncircular opening and the alignment portion 64 is press fit into the noncircular opening. With the insertion of the shaft 50 completely into the noncircular opening 42, alignment portion 64 extends outwardly from the end of the noncircular opening 42 and provides a means to actuate the driver 16 from the other side of the control as seen in FIG. 4.

In a device built in accord with the present invention, each of the sides of the hexagonally shaped driver engagement portion 58 of the shaft 50 contained a nubbin about 0.020 inches wide and 0.003 inches high and the driver engagement portion 58 of the shaft 50 and the alignment portion 64 were dimensioned to press fit within the noncircular opening 42 in the driver 16, the sides of the alignment portion being an extension of the sides of the driver engagement portion. When a metal shaft, e.g., of steel or brass, is employed, it is merely necessary to form the nubbins on the shaft. This can be done by turning the shaft on a suitable tool or machine. The walls of the slot in the driver will provide sufficient resiliency to be able to press the nubbins 62 on the metal shaft through the slot 42 into engagement with the chamfered portion 40 of the hub 34.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed as new and desired to be secured by Letters Patent of the United States is:

1. A variable resistance control comprising a resistance element and a collector in spaced relationship, a rotatable member, a hub integral with the rotatable member and containing an abuttment member, the rotatable member and hub being provided with a noncircular opening, the edge of the hub engaging one of the collector and the resistance element, the abuttment member being provided with a dish shaped surface circularly disposed about the opening, a contactor constrained to rotate with the rotatable member for wiping contact with the collector and the resistance element, a shaft secured to the rotatable member, said shaft comprising a shoulder, a noncircular first shaft portion disposed within the opening and connected to the shoulder, and a noncircular second shaft portion contiguous with the first shaft portion, said first and second shaft portions having substantially the same surfaces conforming to said opening, and a plurality of discrete nubbins supported on said first shaft portion and engaging said abuttment member, said nubbins projecting from said surface of said first shaft portion whereby the second shaft portion prealigns the shaft upright and rigidly within the noncircular opening, said nubbins resiliently engaging the dish shaped surface and providing outward radial pressure on the hub.

2. The control of claim 1, wherein the first shaft portion is hexagonally shaped and interfits the sides of the noncircular opening and wherein one of said plurality of discrete nubbins is integral with each of the sides of the first shaft portion and abuts said abuttment member.

3. The control of claim 1, wherein said hub exerts an outward radial pressure against one of said resistance element and collector thereby affecting the rotational torque of the rotatable element.

4. The variable resistance control of claim 1, wherein said noncircular opening is hexagonally shaped and extends through said rotatable member, the sides of the first and second shaft portions conforming to the sides of said opening and being disposed in an interference relationship therewith.

5. A variable resistance control comprising a mounting bracket, a collector ring embossed from the plane of the mounting bracket and provided with an aperture, a heat deformable hub containing an abuttment member provided with a dish shaped surface rotatably journaled in the aperture, an electrically nonconductive rotatable member integrally secured to the hub in spaced relationship to the mounting bracket, an electrically nonconductive base carried by the mounting bracket and disposed between the mounting bracket and the rotatable member, a skirt depending from the rotatable member and rotatably engaging a portion of the base, a resistance element mounted on the base, a contactor constrained to rotate with the rotatable member wipingly engaging and electrically connecting the collector ring and the resistance element, the rotatable member and the hub being provided with a noncircular opening extending therethrough, a hexagonally shaped first shaft portion disposed within the noncircular opening, an actuator integral with the first shaft portion and forming a shoulder therewith, a hexagonally shaped second shaft portion having sides contiguous with the sides of the first shaft portion, a bearing member integral with the rotatable member, said shoulder abutting the bearing member at one end of the noncircular opening, said second shaft portion extending outwardly from the other end of the noncircular opening and a plurality of discrete nubbins integral with the first shaft portion and abutting the dish shaped surface, one of said nubbins being disposed on each of the sides of said first shaft portion, said nubbins providing outward radial pressure on said hub against said collector ring to thereby affect the rotational torque of the rotatable element.

6. A variable resistance control comprising a resistance element and a collector in spaced relationship, a rotatable member, a hub integral with the rotatable member, the edge of the hub engaging one of the collector and the resistance element, the rotatable member providing a first hexagonal surface, the hub providing a second hexagonal surface communicating with the first hexagonal surface, an abuttment surface, and a rolled-over portion communicating with the abuttment surface, said abuttment surface being disposed intermediate the second hexagonal surface and the rolled-over portion, said rolled-over portion and surfaces defining an opening, a surface of the rolled-over portion being circularly disposed about the opening and being substantially parallel to the hexagonal surfaces, a contactor constrained to rotate with the rotatable member for wiping contact with the collector and the resistance element, a shaft secured to the rotatable member, said shaft comprising a shoulder, a hexagonal first shaft portion disposed within the opening and connected to the shoulder, and a hexagonal second shaft portion contiguous with the first shaft portion, said first and second shaft portions having substantially the same surfaces conforming to the first and second hexagonal surfaces, and a plurality of discrete nubbins supported on said first shaft portion and engaging the abuttment surface.

* * * * *